US008191172B2

(12) United States Patent
Polanish

(10) Patent No.: US 8,191,172 B2
(45) Date of Patent: Jun. 5, 2012

(54) ARM SLEEVE OF KNITTED MESH WITH MOTION FLOW TEAM INDICATORS

(76) Inventor: Lloyd Stephen Polanish, New York, NY (US)

( * ) Notice: Subject to any disclaimer, the term of this patent is extended or adjusted under 35 U.S.C. 154(b) by 248 days.

(21) Appl. No.: 12/689,442

(22) Filed: Jan. 19, 2010

(65) Prior Publication Data

US 2011/0173735 A1 Jul. 21, 2011

(51) Int. Cl.
*A41D 11/00* (2006.01)

(52) U.S. Cl. ..... 2/59; 2/244

(58) Field of Classification Search ..... 2/59, 16, 2/69, 75, 80, 125, 94, 126, 159, 158, 160, 2/161.1, 170, 243.1, 244, 311, 312; 446/26; 40/586; 473/464, 502; 116/35 R
See application file for complete search history.

(56) References Cited

U.S. PATENT DOCUMENTS

| | | | | |
|---|---|---|---|---|
| 2,534,313 | A * | 12/1950 | Starkey | 116/200 |
| 5,010,589 | A * | 4/1991 | Hamilton | 2/1 |
| 5,628,062 | A * | 5/1997 | Tseng | 2/16 |
| 5,638,546 | A * | 6/1997 | Vita | 2/16 |
| 5,819,315 | A * | 10/1998 | Ruffa | 2/69 |
| 6,813,779 | B1 * | 11/2004 | Williams | 2/16 |
| 7,131,156 | B1 * | 11/2006 | Walker-Craft | 5/655 |
| 7,520,074 | B1 * | 4/2009 | Vanova | 40/586 |
| D607,183 | S * | 1/2010 | Stumpfl | D2/858 |
| D634,899 | S * | 3/2011 | Myers | D29/120.1 |
| 2009/0298378 | A1 * | 12/2009 | Segal | 446/26 |

OTHER PUBLICATIONS

Pinnies, Scrimmies & Vests, Sportime icatalog, pp. 430-431, 2009.
Indian Maiden Adult Costume, buycostumes.com, 2009, http://www.buycostumes.com/Indian-Maiden-Adult-Costume/65605/ProductDetail.aspx?REF=SCE-nextag.
Adult 3-PC Indian Princess Costume, Costume Discounters, 2009, http://www.costumediscounters.com/sexy-costumes/indians/3-pc-indian-princess-adult-RM1439. html?code=CSENextag &mr:referralID=91e63016-e40a-11de-8544-000423c27407.
Tribal Princess Costume—Women's Sexy Indian Costume, Costumes Inc., 2009.
Sexy Indian Princess Costume—Women's Sexy Indian Costume, Costumes Inc., 2009.
Pow Wow Princess Costume—Adult Sexy Indian Costume, Costumes Inc., 2009.
Indian Princess Costume—Teen Indian Costume, Costumes Inc,., 2009.
Adult Sexy Native Princess Indian Costume, Candy Apple Costumes, 2009.
Indian Maiden—Sexy Indian Costums, BestCostumeSite.com, 2009.
Blue Indian Maiden sexy womens halloween costume, 2009.
Indian Maiden Costumes (items 2-10 above) enlargements.

* cited by examiner

*Primary Examiner* — Amy Vanatta
(74) *Attorney, Agent, or Firm* — Hess Patent Law Firm PC; Robert J. Hess

(57) ABSTRACT

An arm sleeve with a hollow body made of a mesh material. Both ends of the body have an elastic band, one elastic band being smaller than the other. A fastener, such as one having engaging hooks and loops, is at the larger of the two elastic bands. Strips, flags or ribbons dangle from the underside of the body and are slightly spaced apart from each other in succession.

14 Claims, 7 Drawing Sheets

ARM SLEEVE OF KNITTED MESH WITH MOTION FLOW TEAM INDICATORS

BACKGROUND OF THE INVENTION

1. Field of the Invention

The present invention relates to an arm sleeve having color as a visual contrast and motion flow team indicators, such as dangling ribbons, as a further visual contrast. The arm sleeve is worn by a group of team players or team activity participants and preferably is made of a knitted mesh fabric.

2. Discussion of Related Art

Conventionally, there are pinnies, vests and jerseys. A pinny is a sleeveless dress resembling an apron, worn over clothing. A vest is a sleeveless garment worn as outerwear over a shirt. A jersey is a close-fitting knitted pullover garment worn on the upper half of the body. Each is a one-size-fits all that is typically pulled on over the head, and worn over clothing. The pinnies, vests and jerseys may be made from a knitted mesh material. See http://bellevuecollege.edu/Artshum/materials/indes/Paul/KNITTING.htm.

There is also a wristband, which is pulled onto the upper arm. Also, there are spandex-cotton arm sleeves worn by professional athletes to keep their muscles/joints warm, flexible and/or protected.

A particular group of team players or team participants generally wear pinnies, vests or jerseys of the same color or same color pattern to distinguish themselves from an opposing group of team players or team participants who wear pinnies, vests or jerseys of a different color or different color pattern. Such contrast in color or color pattern of the pinnies, vests or jerseys from those worn by the opposing group of team players or team participants helps fellow teammates recognize each other during the course of team play or team activity.

The present inventor, who has years of experience as a Physical Education teacher and coach, has observed school children participating in team sports and team activities that wear pinnies, vests, or jerseys. His observations include:

Frustration. There is a tendency for young school children to become confused as to which are the correct openings in the pinnies, vests or jerseys for their head, waist, and arms. Mixing them up leads to frustration and wastes time. Since the pinnies, vests or jerseys may be made of a somewhat flexible mesh material, young school children may find that the fabric material at the openings gets caught on themselves if the young school children put the pinnies, vests or jerseys on incorrectly. In addition, the young school children lose a sense of independence in dressing themselves if they require assistance putting on the pinnies, vests or jerseys.

Inadequacy. One benefit in wearing a pinny, vest or jersey on a team is the sense of promoting team spirit during play. While the distinctive color or color pattern of the jersey is a visual cue that may help promote team play, it is actually greatly enhanced as a visual cue by the addition of motion as the player moves his/her body around wearing the shirt jersey during sports play. However, for team players that are unable to move in the same manner as other team players due to a disability (such as being wheelchair bound), they may feel their disability makes them inadequate at team sports play—as far as enhancing the team's visual cues as compared to what their non-disabled teammates are able to do.

Unsanitary condition. The reality is that pinnies, vests and jerseys seldom, if ever, get laundered for school sports play. They are passed out to youngsters to put on themselves during gym class when the gym class for team sports. Although they are worn over the clothes, they must pass over a child's face.

Most germs and bacteria are transmitted through the orifices of the face (i.e., eyes, nose, mouth). Therefore, the germs, bacteria and sweat from each child are passed onto the pinny vest or jersey as it is being put on or taken off. Once off, the pinny, vest or jersey is placed in a pile or hung up for use by a child in another gym class, thereby making the next child susceptible to those same germs and thus the spread of disease. This gives rise to an unsanitary and unclean condition.

Improper Fit. Pinnies, vests and jerseys come in different sizes. School children who wear the jerseys also come in different sizes. Ideally, the jersey worn by a particular child should fit properly. However, there may be an insufficient number of jerseys of a particular size or color that is needed for a class. If so, it may be necessary to make do with whatever jerseys are available. This can lead to a particular child wearing a jersey that fits improperly, i.e., is really too small (and therefore too tight) or too large (and therefore too loose) for that particular child. The child may feel ill at ease about wearing an ill fitting jersey, not only because of the poor fit but also because it may bring unwanted attention, if all the other teammates wear jerseys that fit them properly.

It would be desirable to provide an apparel item having visual cues that are the same as those of fellow teammates yet distinguished from apparel items worn by opposing teammates. It would be preferable for such an apparel item to accomplish this without the same level of frustration, inadequacy, unsanitary condition and improper fit as experienced by youngsters wearing conventional jerseys in team sports or team activities.

SUMMARY OF THE INVENTION

One aspect of the invention resides in a hollow sleeve with an elongated hollow body between two ends. The body is made of a flexible, knitted mesh material, preferably jersey knitted mesh. Each of the two ends has a retention component such as an elastic material that stretches against bias to form openings that accommodate insertion of a human arm. One of the ends has a further retention component in the form of a plurality of a strap of hook and loop fasteners arranged to cling or engage each other when folded over on itself. At least one flow motion team indicator, such as a strip, ribbon or flag, dangles from the body. Preferably, there is a plurality of flow motion team indicators each spaced apart from each other in succession along a direction of elongation of the body.

The motion flow team indicators preferably wave independently of each other and the sleeve during any type of movement of the elongated hollow body through air. Each strip, ribbon or flag preferably has a respective solid color, alternating ones of the ribbons having a common solid color and a remainder of the strips, ribbons or flags having another solid color different from the common solid color.

The elastic material may be elastic bands sewn to respective ones of the two ends. The motion flow team indicators may be sewn to the elongated hollow body between the two ends of the body of the arm sleeve.

BRIEF DESCRIPTION OF THE DRAWING

For a better understanding of the present invention, reference is made to the following description and accompanying drawings, while the scope of the invention is set forth in the appended claims.

DESCRIPTION OF THE PREFERRED EMBODIMENT

Figure 1:
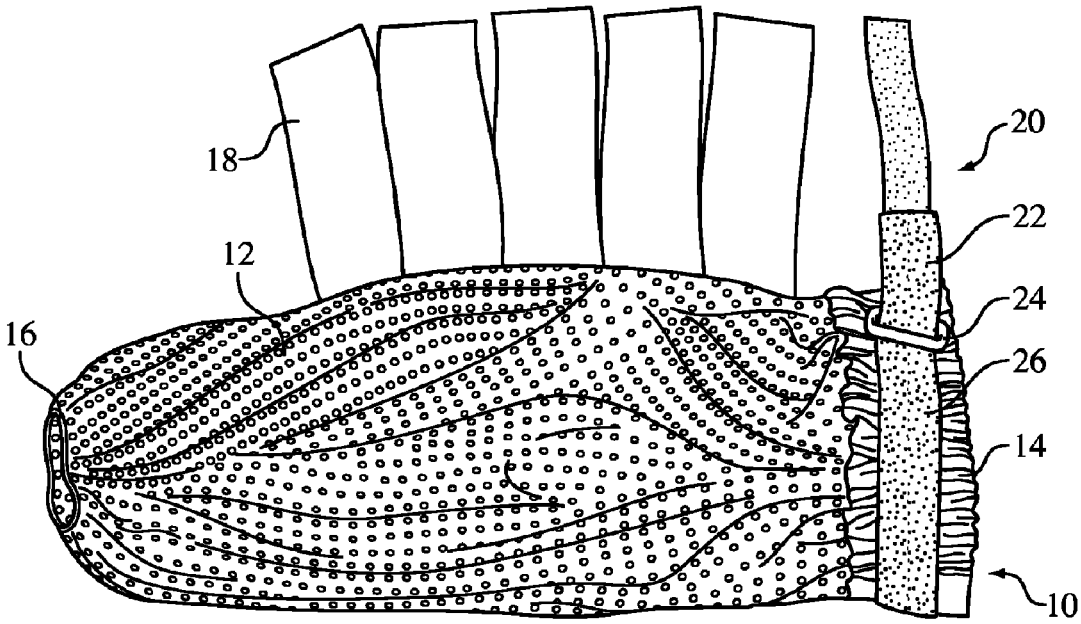
FIG. 1 is a front view of the arm sleeve in accordance with the invention laying in a flattened condition with the hook and loop fastener in an opened condition.

The present invention is intended for easy identification and use during team sports and activities. It enables players to identify teammates and differentiate opposing players by the color of the arm sleeve and movement of motion flow team Indicators. The present invention is designed for use by children ages 5 and up. It can be used for team identification during group games and activities at school or on the practice field. It is intended to replace the standard team pinnies-vests-jerseys that children all over the country currently wear during gym class and other team sports.

It is an adjustable, breathable mesh sleeve that slips on the arm (over both long and short sleeve shirts). It is secured to the arm by a hook and loop fastener attachment, around the upper bicep and tricep muscle. It is made of mesh material, nylon, and elastic and can be produced in various solid colors. Hanging from the side are alternating nylon color strips or ribbons or flags (which exemplify the motion flow team indicators to further attract attention and distinguish teams/players from one another.

Pinnies-vests-jerseys, after many children have exercised-played in them, retain and exude odors. Standard pinnies-vests-jerseys cover the entire core of the body, (chest and back). After a game, practice or gym class, the pinnies-vests-jerseys become hot/heated and retain the smell and moisture of the students'/athletes' bodies. They are often then passed on to the next group of students/athletes repeatedly throughout the day. Additionally, because most school physical education teachers and coaches do not have access to cleaning facilities (i.e. washers and dryers) at school or near the playing fields, most of these articles of clothing rarely get washed or disinfected on a daily, monthly or even yearly basis. They sit in a bag until the next use, and so do the germs, bacteria and odors.

Pinnies-vests-jerseys maintain germs, odors, dirt and bacteria. As the children don and doff the pinnies-vests-jerseys over their heads the pinnies-vests-jerseys come in direct contact with their mouth, eyes, ears, nose and hair, (passing over 4 major mucus membrane areas). This provides ample opportunity for the spreading of various communicable diseases such as: Fifths Disease, Pink Eye (Conjunctivitis), Strep Throat, H1N1, seasonal flu/influenza, lice, bed bugs, Ring worm and other seasonal colds and infections prevalent in school aged children.

There is a serious choking hazard involved when young children don, doff and play games wearing pinnies-vests-jerseys.

The pinnies-vests-jerseys are often ill-fitting and can be uncomfortable for children of various ages and sizes to wear. (I.e., they are extremely tight and constricting on an overweight child.) Additionally, they can be too big and cumbersome for smaller children.

For children going through puberty, such as young girls, pinnies-vests-jerseys can be quite embarrassing as their shirts might get caught and pulled up as they remove the pinnies-vests-jerseys. This allows for indecent exposure in the school environment (i.e., young boys or adult teachers may inadvertently be exposed to the private parts of a young female student).

For handicapped children, especially those confined to a wheelchair, wearing pinnies-vests-jerseys presents a challenge. It is difficult for them to put them on or take them off independently. Pinnies-vests-jerseys are often not easily viewable on a child who is seated amongst students who are standing when playing a game.

For younger children, independence and timing is also an issue. Teachers and coaches often have to spend an inordinate amount of time helping children don and doff the pinnies-vests-jerseys. This wastes valuable instructional/coaching and playing/practice time. Not to mention it puts the coach in harms way of every child's germs.

The present invention is an arm sleeve, preferably made of knitted mesh pinnies-vests-jerseys material that is breathable, flexible and durable. It comes in various bright colors and sizes. It has color motion flow team indicators (strips or ribbons or flags) hanging from the side. It has elastic at the bottom of the sleeve and both elastic and Velcro (hook and loop fasteners) at the top of the sleeve for a tighter, more comfortable fit. It is worn directly on the arm (skin) or over clothing.

The benefits are many:

Because the arm sleeve of the present invention may be only worn on one arm, it does not become as heated or sweaty in contrast to pinnies-vests-jerseys worn on the chest.

Likewise, it does not come in direct or constant contact with the orifices of the face (eyes, ears, nose, and mouth). It also does not have to touch the head/hair of the student. Therefore, it does not come in contact with, nor can it retain or spread, as many communicable germs and diseases.

There is no choking hazard involved with apparel worn on the arm.

The arm sleeve of the present invention comes in various, adjustable sizes. It fits children of all ages and sizes (whether or not they are overweight). This is due to the fact that arm length and width does not vary dramatically with height, weight or age. Example: A $5^{th}$ grade student can weigh 165 lbs and stand 5 feet 7 inches and in the same class a $5^{th}$ grade student can weigh 100 lbs and stand 4 feet 11 inches tall. Both of these students cannot wear the same pinny-vest-jersey. However, the very same two students have a difference of 2 inches in arm length, 1 inch in wrist size and 1.5 inches in upper bicep circumference. Both students would comfortably fit into the same arm sleeve of the present invention.

There is no risk of inappropriate exposure of body parts when donning and doffing the arm sleeve of the present invention, as it does not involve the student's chest and stomach area.

For handicapped children, it is easier to put on and the colored strips or ribbons or flags help further distinguish them when they are playing games (as they might wave their arms, whereas pinnies-vests-jerseys in a seated position amongst students who are standing is not as visible).

For younger children, the arm sleeve of the present invention is much easier to independently don and doff. When and if the student does need help, it is not as time-consuming or potentially harmful-unsafe-risky for the teacher/coach to assist.

The wearing of the arm sleeve of the present invention makes it easier for youngsters to see their fellow teammates versus their opponents when playing games, in comparison to pinnies-vests-jerseys. Indeed, the arm sleeve of the present invention is easier to put on and take off, feels better, looks better and is "cooler" than conventional pinnies-vests-jerseys.

Figure 2:
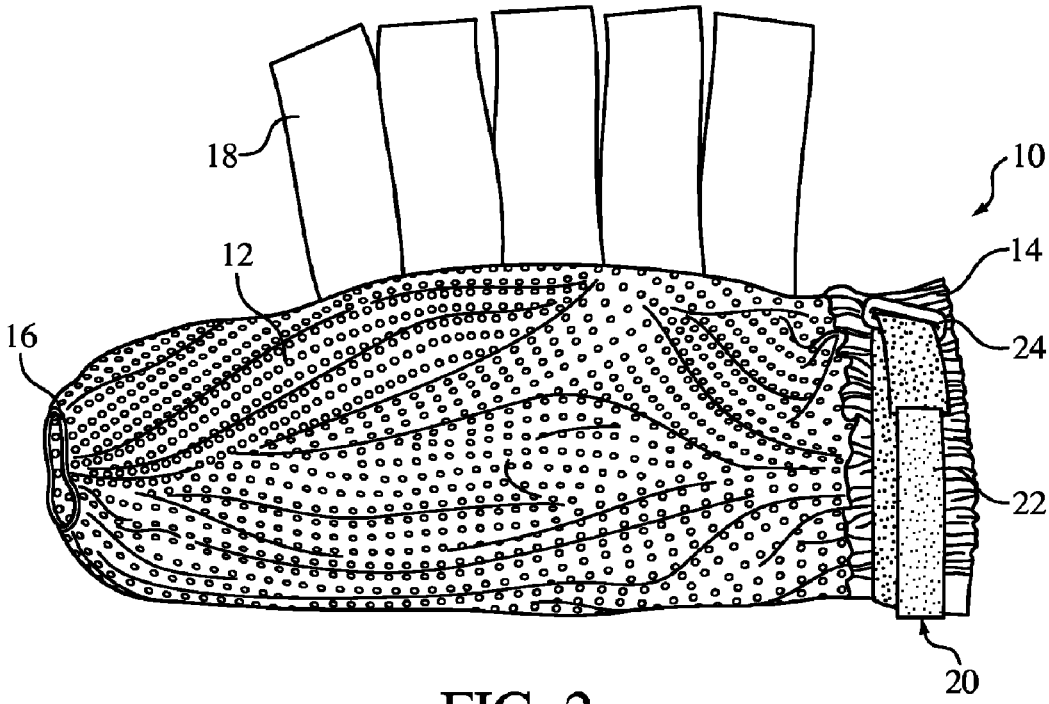
FIG. 2 is a front view of the arm sleeve laying in a flattened condition as in FIG. 1, but with the hook and loop fastener in a closed condition.
Figure 3:
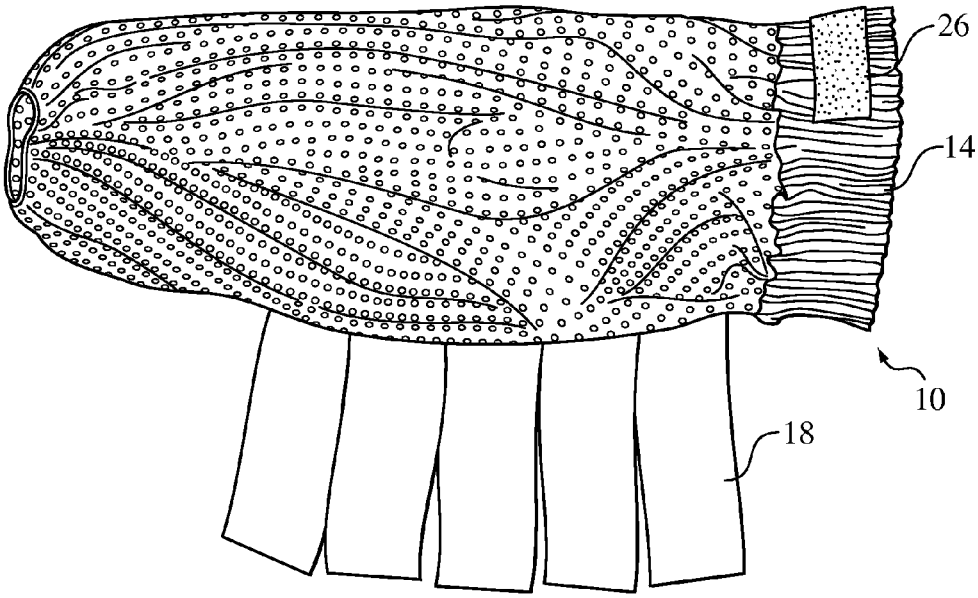
FIG. 3 is a rear view of FIG. 2.

FIGS. 1-3 show an arm sleeve 10 in a flattened condition in accordance with the invention. The arm sleeve 10 includes an elongated hollow body 12 made of a jersey mesh material, an elastic band 14 at one end of the elongated hollow body 12 and a smaller elastic band 16 at the other end of the body 12. A series of motion flow team indicators 18 are arranged in succession, one after the other, from the underside of elongated hollow body 12. The motion flow team indicators 18 may be, for instance, strips, ribbons or flags that dangle.

The end with the larger elastic band 14 also has a fastener 20. The fastener 20 may include a strap 22, loop 24, and a hook and loop fastener patch 26 that can secure to itself when bent about the loop 24 as exemplified by moving the fastener 20 from the position of FIG. 1 to the position of FIG. 2. In effect, the larger elastic band 14 and the fastener serve as an upper arm retention component, while the smaller elastic band 16 serves as a lower arm retention component. Together, the upper arm retention component and the lower arm retention component are spaced from each other and configured to resist their relative displacement along the arm as the elbow flexes over its full range of flex.

While the use of both the larger elastic band 14 and the fastener 20 is preferred for secure retention to the upper arm, one might instead dispense with one of them so as to rely on just the larger elastic band 14 for retention to the upper arm or rely on just the fastener 20 for retention to the upper arm. However, the retention to the upper arm will likely not be as secure without both the larger elastic band 14 and the fastener 20. If not, the wearer may find it necessary to adjust the position of the arm sleeve on the upper arm from time to time.

Figure 4:
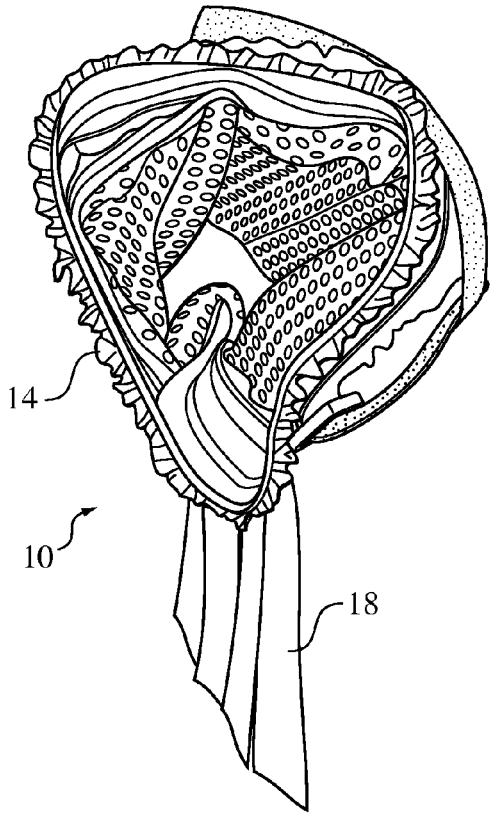
FIG. 4 is an end view from the right of FIG. 2, but showing the arm sleeve in an open, unflattened condition by being held open, which reveals the interior hollow of the arm sleeve.
Figure 5:
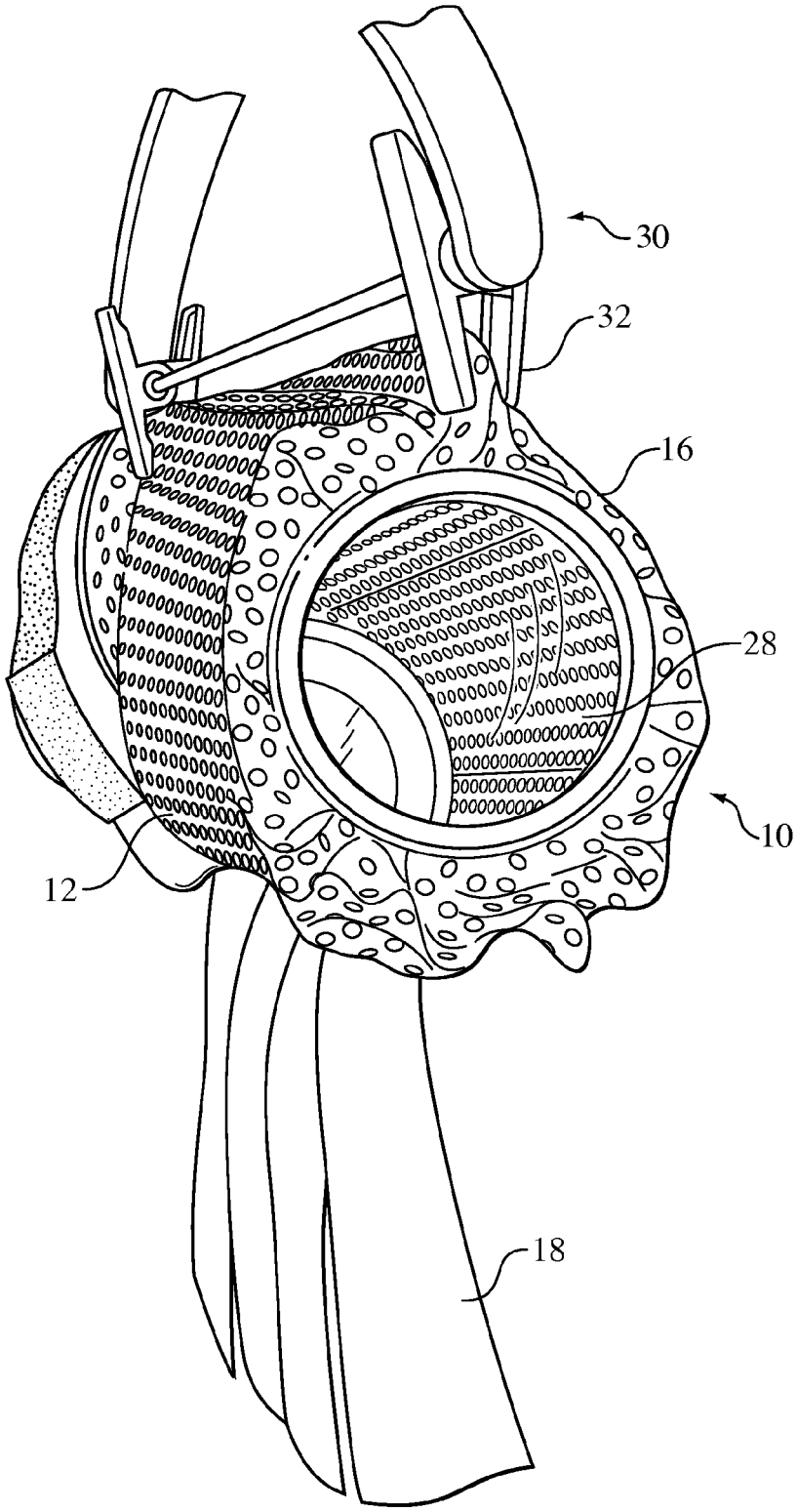
FIG. 5 is an end view from the left of FIG. 2, but showing the arm sleeve in an open, unflattened condition with a cylindrical drinking glass inserted in the hollow of the arm sleeve to reveal the interior hollow of the arm sleeve. The arm sleeve is suspended from an apparel hanger.
Figure 6:
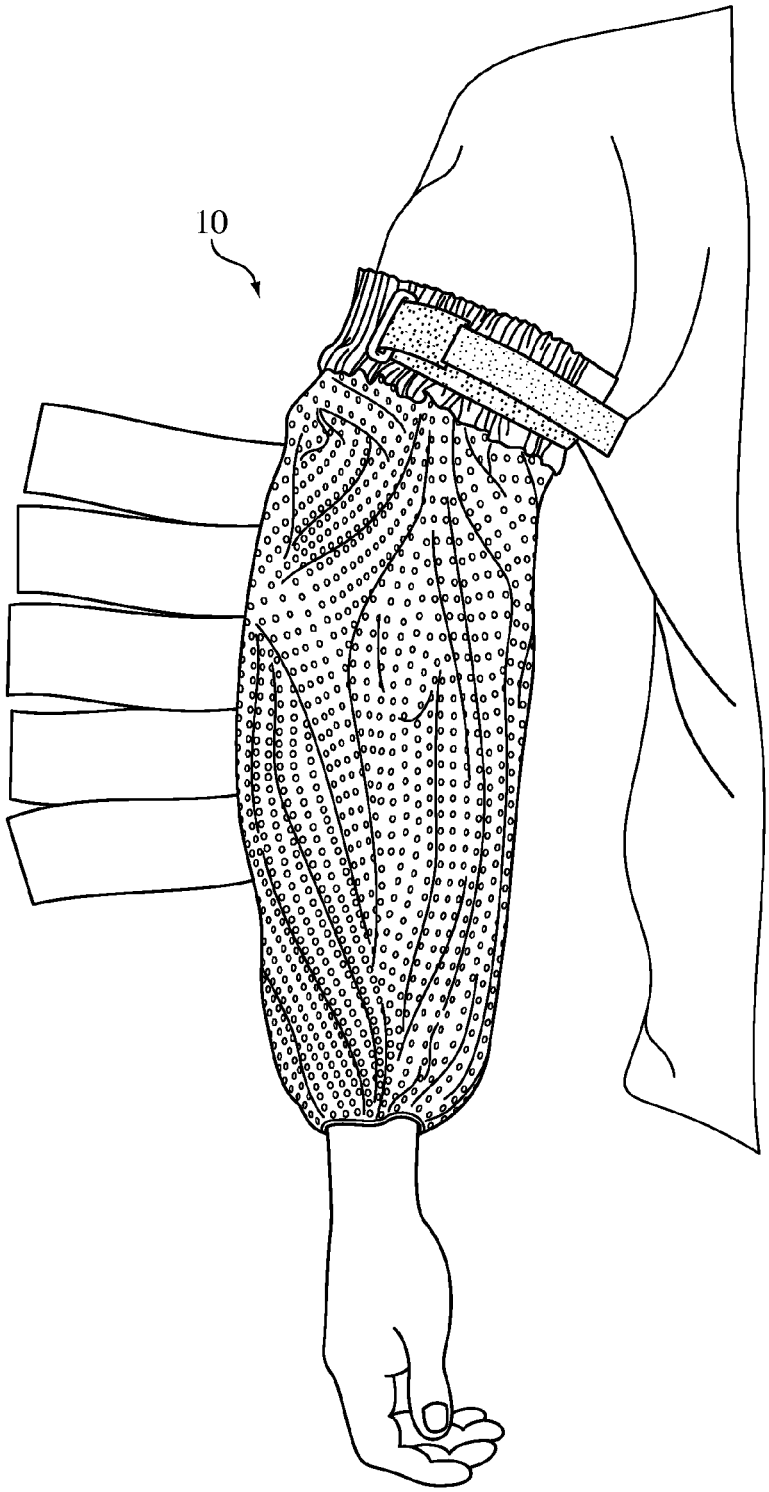
FIG. 6 is a front view as in FIG. 2, but being worn on a human arm directed downward.
Figure 7:
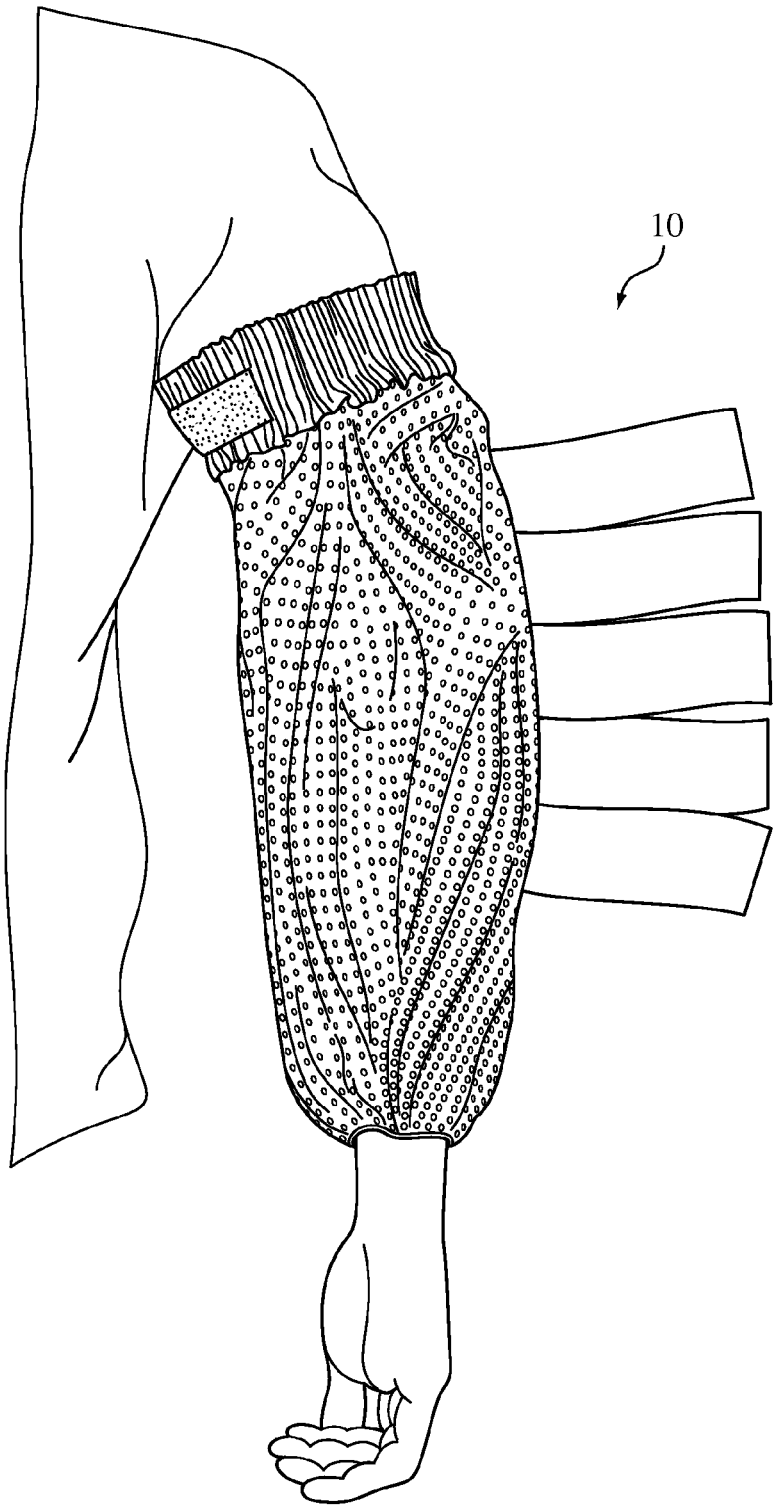
FIG. 7 is a rear view as in FIG. 3, but worn on a human arm directed downward.

FIGS. 4 and 5 show the arm sleeve 10 in an open, unflattened position with the motion flow team indicator 18 dangling downward from an underside of the elongated hollow body 12. FIG. 5 shows a cylindrical drinking glass 28 inside the hollow of the arm sleeve to reveal the interior of the elongated hollow body 12, with the arm sleeve 10 suspended by a conventional hanger 30 having dual spaced apart spring loaded clips 32.

Figure 8:
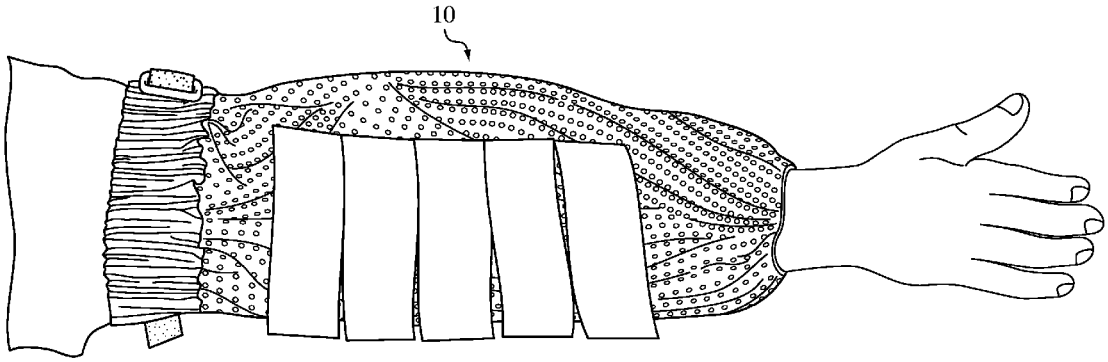
FIG. 8 is a rear view as in FIG. 7, but with the human arm extended in a general horizontal direction.
Figure 9:
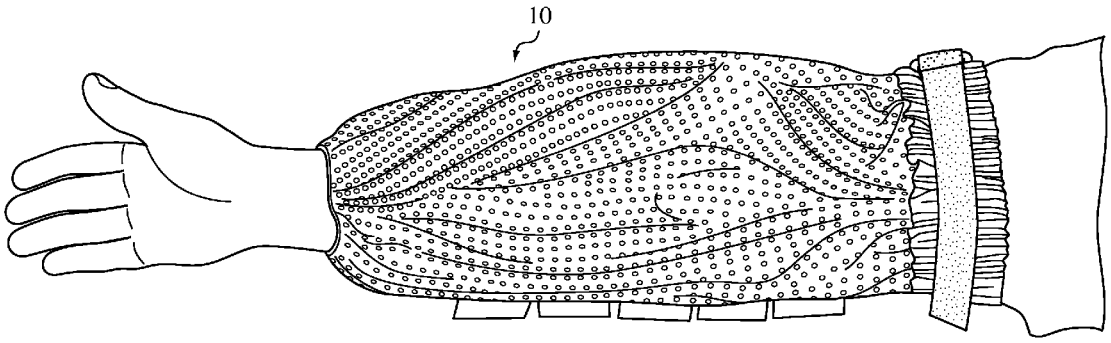
FIG. 9 is a front view as in FIG. 6, but with the human arm extended in a general horizontal direction.

FIGS. 6-9 show the arm sleeve 10 being worn on a human arm, with the human arm in a generally vertical, downward position (FIGS. 6-7) and in a generally horizontal, outward position (FIGS. 8-9). The arm sleeve 10 extends over the elbow. As such, there is an enhancement of the motion effect over an arm sleeve that just covers part of the upper arm or a wrist band that covers just part of the lower arm. This is because the motion effect is realized by motion of the upper arm alone, the lower arm alone or both the upper and lower arms in concert with each other.

Since the arm sleeve is a solid color or color pattern, the visual effect is more striking visually as the wearer bends the elbow in contrast to arm sleeves that cover just part of the upper arm (not reaching the elbow) or wrist bands that cover just part of the lower arm. Moreover, the silhouette of the body in motion becomes more noticeable in the color or color pattern of the arm sleeve than would otherwise be the case if the arm sleeve did not cover the elbow.

Preferably, the opposite ends of the elongated hollow body of the arm sleeve are spaced from each other by a distance sufficient to accommodate an elbow of the human arm remaining spatially between the opposite ends as the elbow flexes over an entire range of flex, while one of the ends of the body is closer to the shoulder of the human arm than to the elbow and the other of the ends of the body is closer to the wrist of the human arm than to the elbow.

Figure 10:
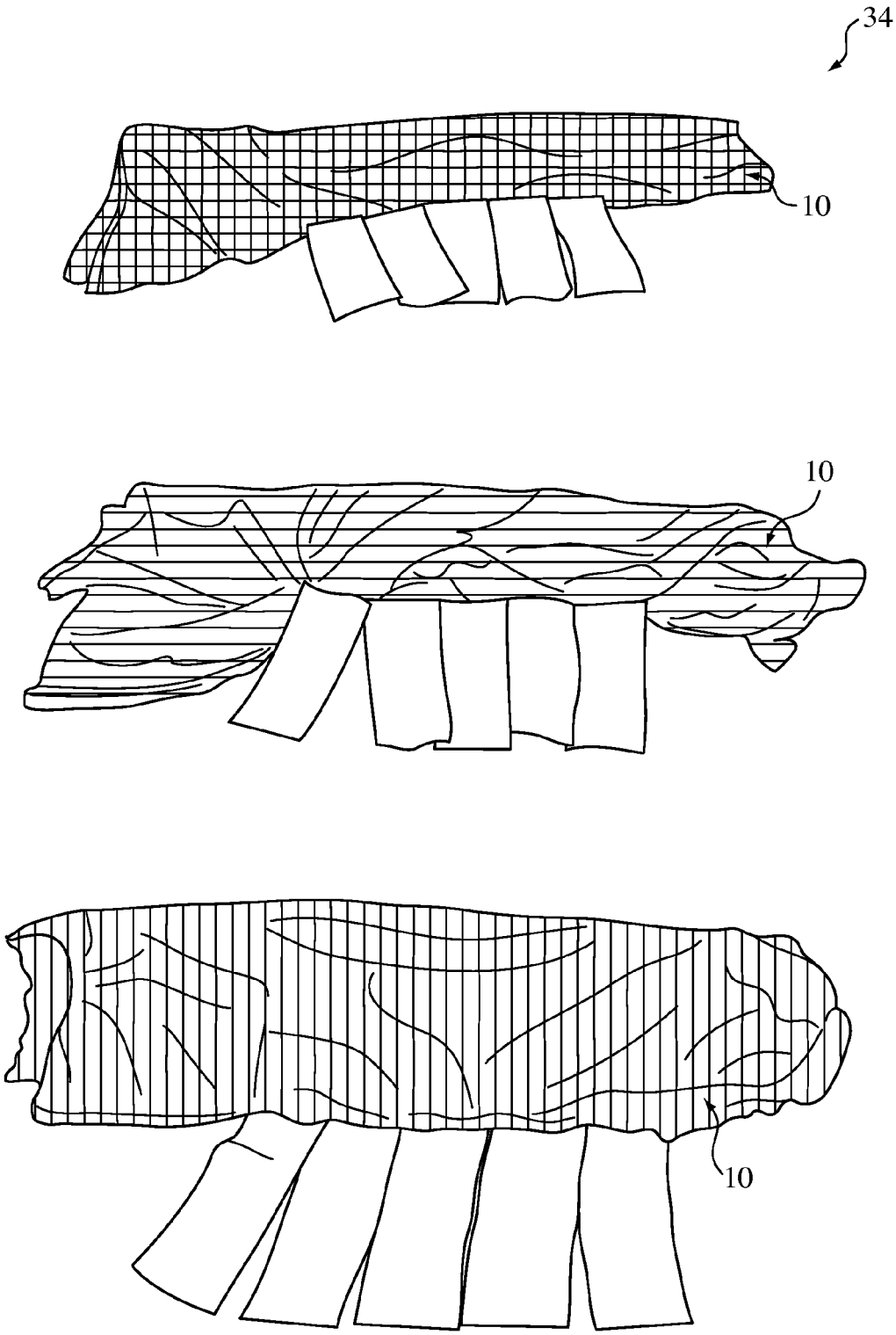
FIG. 10 is a front view of three arm sleeves in accordance with the invention each in a flattened condition, but without hook and loop fasteners.

FIG. 10 shows three elongated hollow bodies 12 in flattened position resting upon a horizontal flat surface 34 and each of a different color. Respective sets of the ribbons/flags 18 are attached to the three elongated hollow bodies 12. The elastic bands and the fastener of FIGS. 1-8 have been removed. For the sake of brevity, the fabric mesh holes are omitted in FIG. 10.

In all the embodiments, the motion flow team indicators 18 are sewn to a respective one of the elongated hollow bodies 12. Turning to FIGS. 1-9, associated elastic bands 14, 16 are likewise sewn to respective ends of the respective one of the elongated hollow bodies 12. The fastener 20 and loop 24 are likewise sewn to the larger elastic band 14.

The motion flow team indicators 18 may be of solid colors or color patterns and arranged in succession. An initial set of alternating ones of the motion flow team indicators 18 may have the same solid color (or color pattern). The motion flow team indicators 18 of this initial set alternate with the motion flow team indicators 18 of a further set. The motion flow team indicators 18 of the further set have a different solid color (or color pattern) than that of the motion flow team indicators 18 of the initial set.

Preferably, the arm sleeve of the present invention is not attached to a torso body of a jersey. It is desirable to avoid using the torso body of a jersey altogether and for that reason the arm sleeve of the present invention is self-securing to the human arm via the elastic bands and fastener and free of being secured to the torso body of a jersey.

While the foregoing description and drawings represent the preferred embodiments of the present invention, it will be understood that various changes and modifications may be made without departing from the scope of the present invention.

What is claimed is:

1. An arm sleeve, comprising an elongated hollow body of knitted mesh material that has opposite ends, a plurality of alternating sets of motion flow team indicators that are elongated to dangle directly from the elongated hollow body in an alternating manner such that the motion flow team indicators of one of the alternating sets are arranged to alternate with the motion flow team indicators of a further of the alternating sets, the motion flow team indicators of the one of the alternating sets having a solid color or color pattern that differs from a solid color or color pattern of the motion flow team indicators of the further of the alternating sets, and retention components spaced apart from each other and configured to retain the opposite ends of the elongated hollow body in relative position along the human arm against their displacement as the elongated hollow body covers an elbow of the human arm that flexes over an entire range of flex.

2. The arm sleeve of claim 1, wherein the retention components are selected from a group consisting of elastic material at one of the opposite ends of the elongated hollow body, a fastener at the one of the opposite ends that may be manually opened and closed, further elastic material at the other of the opposite ends of the elongated hollow body, and any combination thereof.

3. The arm sleeve of claim 1, wherein the elongated hollow body is configured so that the opposite ends of the elongated hollow body are spaced apart on the human arm with the elbow covered and so that one of the opposite ends of the elongated hollow body is closer to a shoulder of the human arm than to the elbow and the other of the opposite ends of the elongated hollow body is closer to a wrist of the human arm than to the elbow.

4. The arm sleeve of claim 1, wherein the plurality of the alternating sets of the motion flow team indicators each having an associated free end that waves independent of each other during movement of the elongated hollow body through air.

5. The arm sleeve of claim 1, wherein the plurality of the alternating motion flow team indicators includes sets of strips, ribbons or flags.

6. The arm sleeve of claim 2, wherein the fastener includes a strap with a plurality of hook and loop fasteners configured to cling in a releasable manner to themselves upon bending of the strap in a manner that brings the plurality of hook and loop fasteners into contact with themselves.

7. The arm sleeve of claim 1, wherein the retention components are sewn to the elongated hollow body at respective ones of the two ends, with the plurality of motion flow team indicators being sewn to the elongated hollow body independent of each other.

8. A method of wearing an arm sleeve on a human arm, comprising wearing on the human arm an elongated hollow body of knitted mesh material that has opposite ends, dangling a plurality of alternating sets of motion flow team indicators directly from the elongated hollow body, retaining the opposite ends of the elongated hollow body to the human arm while the elongated hollow body covers an elbow of the human arm in a manner that is resistant to displacement of the opposite ends along the human arm, dangling the plurality of alternating sets of the motion flow team indicators in an alternating manner such that the motion flow team indicators of one of the alternating sets are arranged to alternate with the motion flow team indicators of a further of the sets, the motion flow team indicators of the one of the sets having a solid color or color pattern that differs from a solid color or color pattern of the motion flow team indicators of the further of the alternating sets.

9. The method of claim 8, further comprising selecting the retention components from a group consisting of elastic material at one of the opposite ends of the elongated hollow body, a fastener at one of the opposite ends that may be manually opened and closed, further elastic material at the other of the opposite ends of the elongated hollow body, and any combination thereof.

10. The method of claim 8, further comprising arranging the elongated hollow body so that as the opposite ends of the elongated hollow body are spaced apart on the human arm with the elbow covered, one of the opposite ends of the elongated hollow body is closer to a shoulder of the human arm than to the elbow and the other of the opposite ends of the elongated hollow body is closer to a wrist of the human arm than to the elbow.

11. The method of claim 8, further comprising waving the plurality of alternating sets of the motion flow team indicators independent of each other during movement of the elongated hollow body through air.

12. The method of claim 8, wherein the plurality of alternating sets of the motion flow team indicators includes sets of strips, ribbons or flags.

13. The method of claim 8, wherein the fastener includes a strap with a plurality of hook and loop fasteners, further comprising bending the strap so as to cling the hook and loop fasteners to themselves in a releasable manner by bringing the hook and loop fasteners into contact with themselves.

14. The method of claim 8, wherein the retention components are sewn to the elongated hollow body at respective ones of the two ends, with the at least one motion flow team indicator being sewn along the exterior length of the elongated hollow body.

* * * * *